US006209849B1

(12) United States Patent
Dickmeyer

(10) Patent No.: US 6,209,849 B1
(45) Date of Patent: Apr. 3, 2001

(54) ICE CUBE TRAY

(75) Inventor: Jon S. Dickmeyer, Fallbrook, CA (US)

(73) Assignee: H & D Product Development, LLC, Fallbrook, CA (US)

( * ) Notice: Subject to any disclaimer, the term of this patent is extended or adjusted under 35 U.S.C. 154(b) by 0 days.

(21) Appl. No.: 09/219,021

(22) Filed: Dec. 23, 1998

(51) Int. Cl.[7] ..... B28B 7/24
(52) U.S. Cl. ..... 249/120; 249/121; 249/126
(58) Field of Search ..... 249/119, 120, 249/121, 126

(56) References Cited

U.S. PATENT DOCUMENTS 1,964,476 6/1934 Newman .
2,100,288 * 11/1937 Horlacher ..... 249/120
2,166,560 7/1939 Schmelzer .
2,247,018 6/1941 Henning .
2,247,019 6/1941 Henning .
2,946,207 * 7/1960 Hulterstrum ..... 249/121
5,071,331 * 12/1991 Falco ..... 249/121

* cited by examiner

*Primary Examiner*—James P. Mackey
(74) *Attorney, Agent, or Firm*—Lyon & Lyon LLP

(57) ABSTRACT

There is disclosed herein an ice cube tray device particularly for use on moving vehicles, such as boats and the like, comprising a top member having a plurality of cap like members attached to the underside thereof. The device further includes a plurality of containers detachably mounted on the cap members and which can receive liquid to be frozen in each of the containers.

14 Claims, 2 Drawing Sheets

ICE CUBE TRAY

The present invention relates to ice cube trays, and more particularly to a device of this nature for use on moving vehicles, such as sailboats and the like.

Various forms of ice cube trays and like devices have been devised over the years. The typical tray comprises an elongated unit with a number of receptacles into which water is disposed, and the tray is placed in a freezer compartment of a refrigerator or other form of cooling device wherein the water freezes into ice cubes. Other devices of this nature include fully enclosed plastic containers which are partially filled with water, placed in the refrigerator, and once the water has frozen individual cubes can be shaken loose from the container.

These and similar types of devices serve their purpose well. However, in the case of a vehicle which moves, such as a sailboat, power boat and the like, an added problem exists; namely, the likelihood of water sloshing from an ice cube tray as the boat tips or rocks, and this also hampers freezing because of movement of the vehicle. Needless to say, if the water slouches from the tray it results in water in and around the freezing compartment and ultimately freezes, possibly causing the tray to stick, and other similar problems.

SUMMARY OF THE INVENTION

According to the concepts of the present invention, an ice cube tray device comprises a plurality of individual receptacles which are attachable to and detachable from a holding member such that the receptacles are each capped to prevent water or other liquids from sloshing therefrom in the event of movement prior to freezing of the liquid. Preferably, the containers are small plastic containers the tops of which fit within caps, much like containers for dispensing pharmaceutical pills and capsules. The caps are attached to the underside of a planar holder member in a suitable manner such as by fasteners or an adhesive, or formed integral with the planar member. In this way, one or more of the containers are supplied with water or other liquid to be frozen, and then reattached to the caps, and the device placed in a freezer compartment. When it is desired to use an ice cube or ice cubes, one or more of the containers are detached from the caps, and the resulting ice cubes are popped into the glass or other receptacle holding the liquid to be cooled. The containers can be any size, but typically they are selected to be of a size which holds one to several ounces of liquid. The holder preferably has a peripheral lip at the top to facilitate stacking of several of the ice cube trays, and has a rib or ridge to add rigidity.

The ability to detach one container to provide ice for one drink, for example, is particularly convenient and advantageous. Thus, individual molded cubes or solid cylinders of ice can be provided.

Accordingly, it is a principal object of the present invention to provide a new form of ice cube tray device.

Another object in the present invention is to provide an ice cube tray device having a plurality of containers individually detachable from a holder and wherein each container is essentially sealed into a cap on or in the underside of the holder, and each container is individually detachable for dispensing a single ice cube.

DESCRIPTION OF DRAWINGS

These and other objects and features of the present invention will become better understood through consideration of the following description taken in conjunction with the drawings in which.

DETAILED DESCRIPTION

Turning now to the drawings, an exemplary embodiment of the present invention is illustrated. The same includes a top or holder member 10, a plurality of caps 12 fixed to the underside thereof, and a plurality of container's 14 which are detachably connectable with the caps 12. The top member 10 preferably is formed of plastic, and may be clear or colored. A ridge or rib 15 extends perpendicularly upward from the top of member 10 to add rigidity thereto. It is disposed in the center and runs the length of member 10. In this location it does not interfere with stacking of several trays because it will fit in between rows of containers on the next higher tray.

Figure 1B:
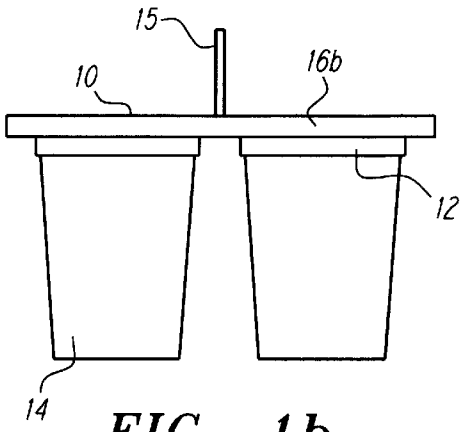
FIG. 1*b* is an end view thereof.
Figure 1A:
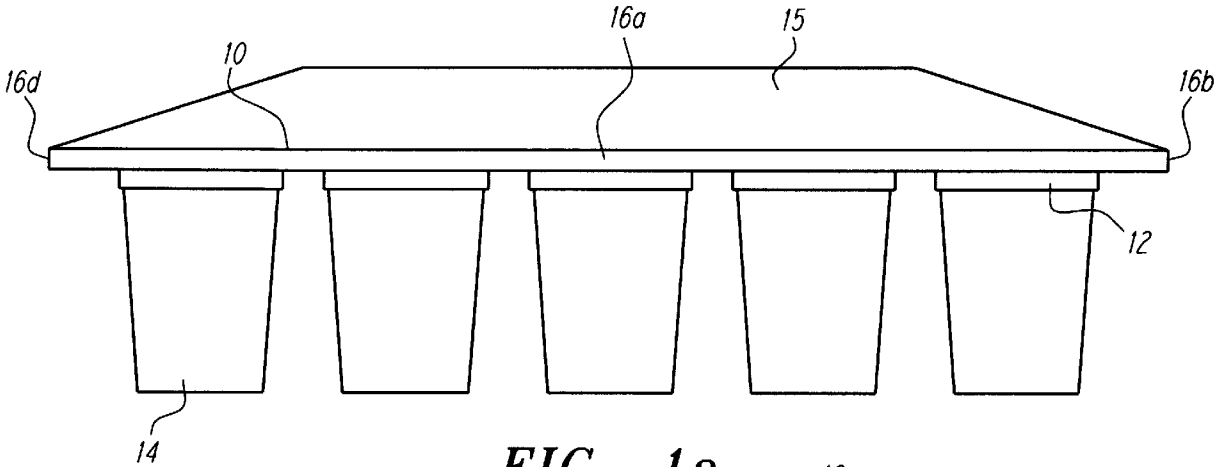
FIG. 1*a* is a side elevational view of an exemplary embodiment of the present invention.
Figure 1C:
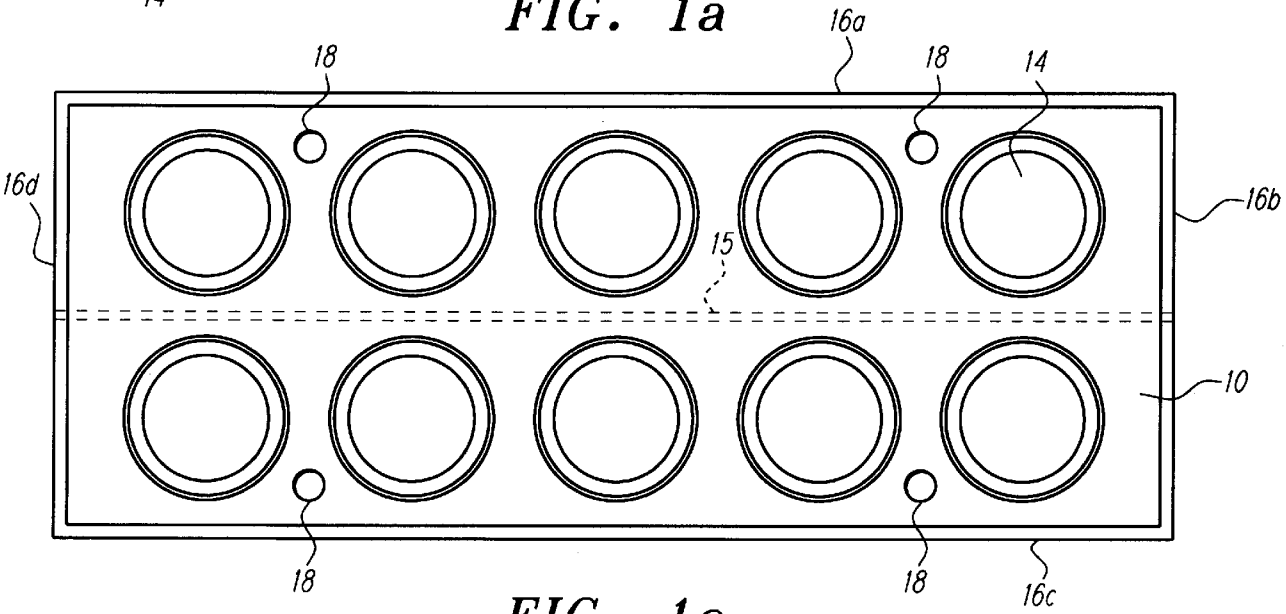
FIG. 1*c* is a bottom view (looking up with from the bottom of FIG. 1*a*)
Figure 2:
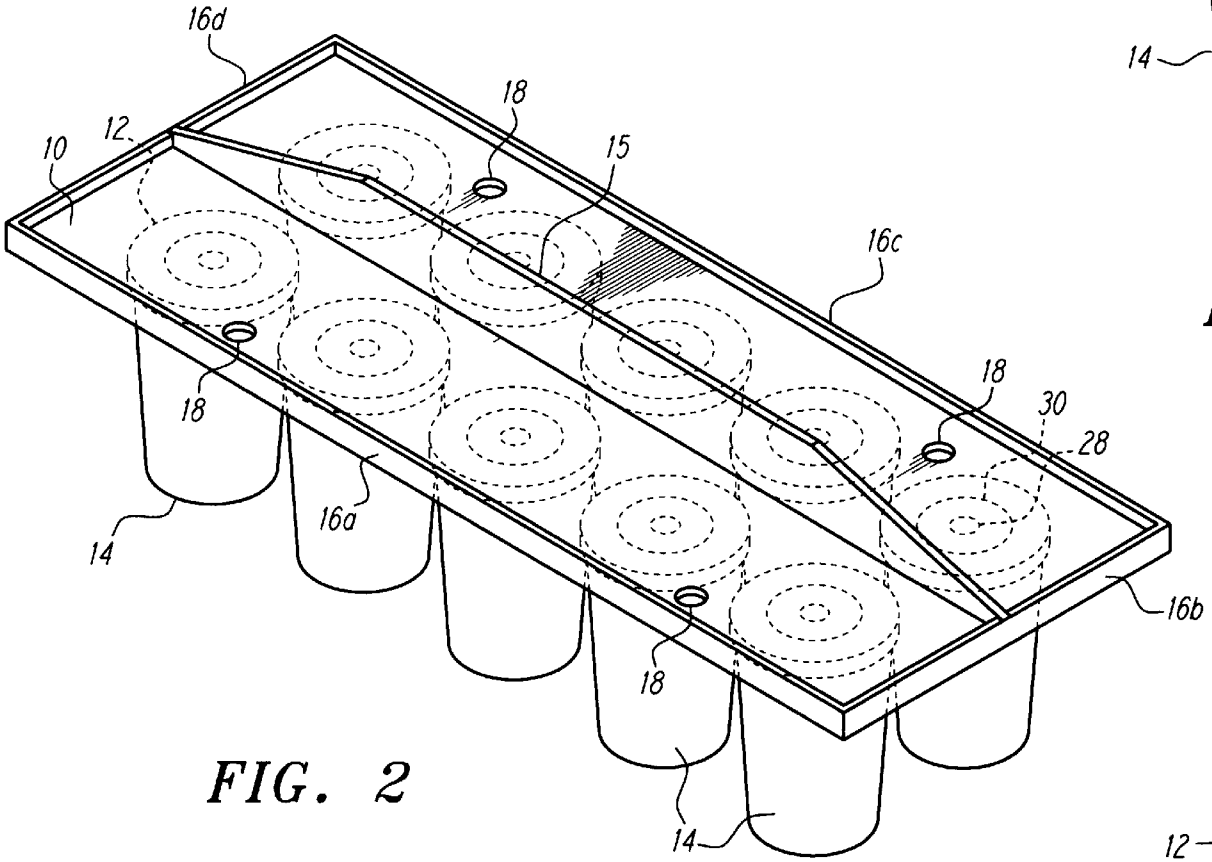
FIG. 2 is a perspective view.

An upstanding lip 16 preferably is provided primarily to allow one of the units of FIGS. 1 and 2 to be stacked one on top of the other, and help contain any liquid that may drip from an upper ice tray unit onto a lower one. Also, preferably four holes 18 are provided on either side of the ridge 15 to allow any such dripping liquid to go downward and flow off of the top member 10 so as to keep stacking trays from being frozen together.

Figure 3:
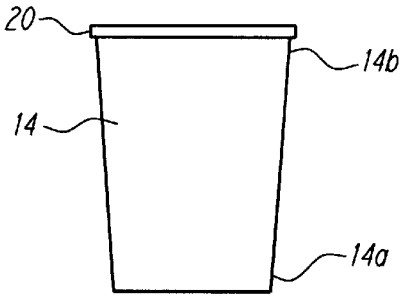
FIG. 3 is a side elevational view of an individual container.
Figure 4:
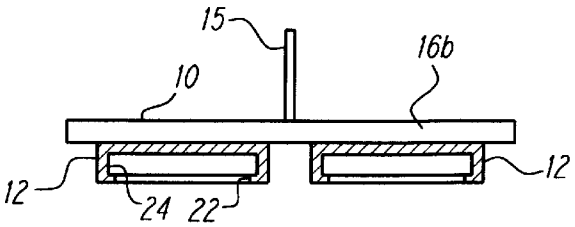
FIG. 4 is a partial end view of the device with the containers removed.

The caps 12 are either formed integrally with top member 10 or are secured in any suitable manner to the underside of the top member 10, such as by a suitable adhesive, heat staking or rivets (not shown). The containers 14 include an upper flange 20 which snaps into a cap 12 in the same manner a plastic pill bottle snaps into its cap. The caps include a lower lip 22 forming a circular cavity 24 into which the flange 20 fits. The containers 14 are frustoconical and have a smaller diameter at the bottom 14*a* than at the top 14*b* (note FIG. 3) to provide a "draft" to facilitate removal of the frozen liquid from the container 14.

The ice tray device of the present invention can be rectangular as shown or can have other shapes. Although ten caps and containers are shown and form a very suitable arrangement, different numbers can be provided. Also, the size of the containers 14 can be any desired size to provide the size ice cube desired. In the exemplary embodiment as shown, the containers hold approximately two ounces of liquid and are approximately 1⅝ inches in diameter and 2¼ inches high. In the event the caps 12 are secured to the member 10 by rivets such as illustrated in phantom at 28 in FIG. 2, it is desired to provide a circular washer 24 on the underside of the cap 12 as seen in FIG. 2 to provide rigidity so as to minimize the chance of the cap 12 being pulled off of the underside of the member 10 when a receptacle 14 is repeatedly removed or detached from its cap.

Although the components have been discussed as formed from suitable plastic material, it will be appreciated that the containers can be plastic or metal, as can the member 10. It is still preferable that the caps 12 be of a somewhat resilient material such as plastic or rubber so that the containers 14 can be easily snapped into and removed from the caps 12; however, threaded caps and containers 14 could be provided if desired.

Preferably, the caps 12 are formed as an integral part of the bottom of the holder 10 by molding all of the caps and the holder as one piece.

The member 10 can slide into a suitable holder (not shown) for holding the edges 16*a* and 16*c* of the member rather than the bottoms of the containers 14 being disposed on a bottom of a freezer compartment.

While embodiments of the present invention have been shown and described, various modifications may be made without departing from the scope of the present invention, and all such modifications and equivalents are intended to be covered.

What is claimed is:

1. An ice cube tray device for providing individual ice cubes and which is particularly useful on moving vehicles such as boats and the like, comprising a planar top member, the top member having a peripheral lip, a plurality of caps on a bottom surface of the top member, and a plurality of liquid containers detachably mounted to and held by the caps, the containers having an upper peripheral lip for mating with a recessed area of the respective caps for securely holding each container onto a respective cap.

2. The device as in claim 1 wherein the top member, caps and containers are all formed of plastic.

3. The device as in claim 1 wherein the top member and caps are integrally formed of plastic.

4. The device as in claim 1 wherein the caps are secured to the top member.

5. The device as in claim 1 wherein each container is formed with draft to facilitate removal of an ice cube therefrom.

6. The device as in claim 1 wherein the caps are adhesively secured to the top member.

7. The device as in claim 1 wherein the caps are secured to the top member by fasteners.

8. The device of claim 7 wherein the fasteners are rivets.

9. An ice cube tray device for providing individual ice cubes and which is particularly useful on moving vehicles such as boats and the like, comprising a planar top member, a plurality of caps secured to a bottom side of the top member, and a plurality of liquid containers detachably mounted to and held by the caps, the containers having an upper peripheral lip for mating with a recessed area of the respective caps for securely holding each container onto a respective cap.

10. The device as in claim 9 wherein the top member, caps and containers are all formed of plastic.

11. The device as in claim 9 wherein the top member and caps are integrally formed of plastic.

12. The device as in claim 9 wherein each container is formed with draft to facilitate removal of an ice cube therefrom.

13. An ice cube tray device for providing individual ice cubes and which is particularly useful on moving vehicles such as boats and the like, comprising:

a solid planar top member, the top member having a top and a bottom surface, a plurality of solid caps secured on the bottom surface of the top member, and a plurality of liquid containers detachably mounted to and held and sealed by the caps, each container having an upper peripheral lip for mating with a recessed area of the respective cap for securely holding each container onto a respective cap.

14. The device as in claim 13 wherein the top member, caps and containers are all formed of plastic, and the top member has a peripheral lip.

* * * * *